United States Patent [19]

Olsen

[11] 3,948,143

[45] Apr. 6, 1976

[54] ELECTROPYROTECHNIC LINK

[76] Inventor: Charles R. Olsen, 307 Conestoga Way, Suite 37, Eagleville, Pa. 19408

[22] Filed: July 24, 1974

[21] Appl. No.: 491,462

[52] U.S. Cl. ..... 89/1 B; 337/401; 337/416

[51] Int. Cl.[2] ..... H01H 37/76

[58] Field of Search ..... 89/1 B; 102/28 R, 28 M; 337/401, 416

[56] References Cited

UNITED STATES PATENTS

| | | | |
|---|---|---|---|
| 3,119,302 | 1/1964 | Barr | 89/1 B |
| 3,362,290 | 1/1968 | Carr et al. | 89/1 B |
| 3,585,933 | 6/1971 | Kos | 102/28 R |
| 3,620,121 | 11/1971 | Olsen | 89/1 B |
| 3,660,794 | 5/1972 | Brizzolara | 337/401 |

*Primary Examiner*—Verlin R. Pendegrass
*Attorney, Agent, or Firm*—McCormick, Paulding & Huber

[57] ABSTRACT

An electropyrotechnic link having one or more connectors crimped or bonded into longitudinal indentations in a closed end tubular member containing a pyrotechnic pressure generator. When the pyrotechnic charge within the tubular member is activated the tubular member is expanded into cylindrical form opening the crimp, peeling any bonding material and releasing the connector or connectors. If the bonding material is of low melting point the release can be made to function upon reaching the melting point of the bonding material or upon command by an electrical signal.

11 Claims, 6 Drawing Figures

ELECTROPYROTECHNIC LINK

BACKGROUND OF THE INVENTION

This invention relates to an electropyrotechnic link which can be activated by an electrical signal to release an object upon command. An electropyrotechnic link is often used in a fire safety system to release a sprinkler system, close a door or shutter or a similar function. In the device of the present invention one or more connectors held in the folds of a longitudinally indented closed end tubular pressure vessel by crimping the folds over the connector or bonding the connector into the folds with adhesive or low temperature solder such as Woods metal. When the pyrotechnic charge is fired by an electrical signal, the tubular case is expanded to resume its original form removing the indents and expelling the connectors. In the bonded version the bonding adhesive or solder is peeled from the connector interface and the connector is expelled. In the optional release mode low temperature bonded connectors will be released when the melting temperature of the bonding material is reached. The electropyrotechnic link of this invention is easy to make and assemble. The connectors may be commercial D rings, wire forms or stampings and the tubular pressure vessel may be a drawn cup.

DESCRIPTION OF PREFERRED EMBODIMENTS

Figure 1:
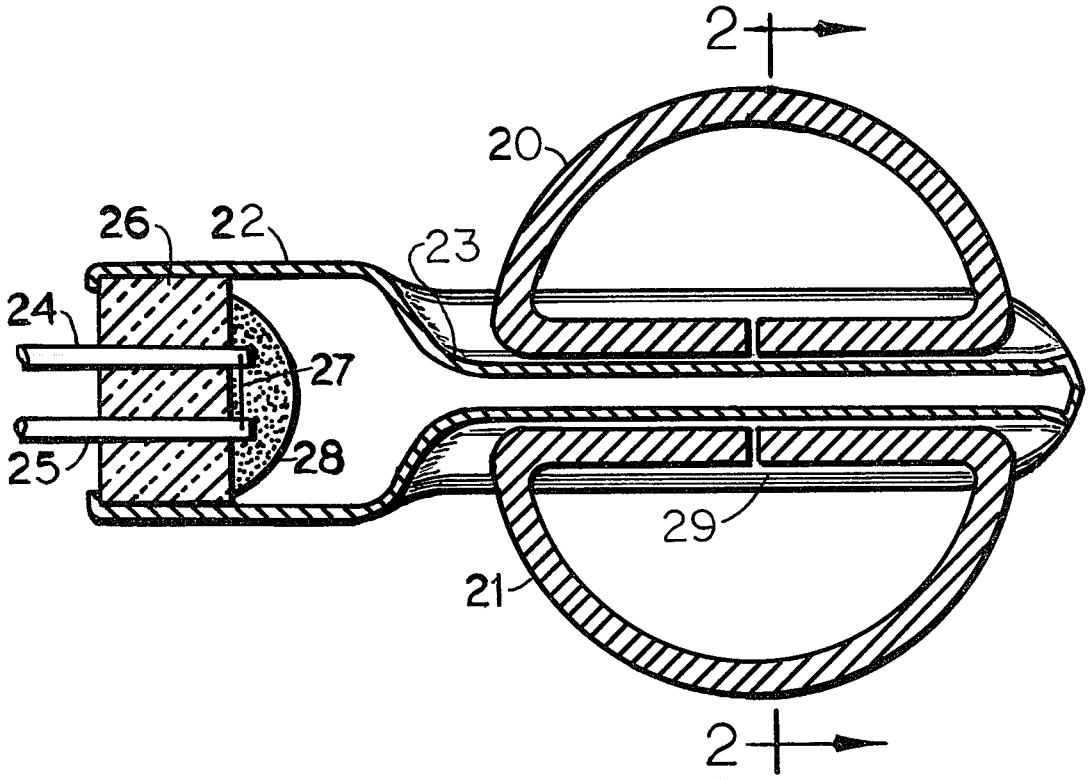
FIG. 1 is a plan view in section of one embodiment of the present invention.
Figure 2:
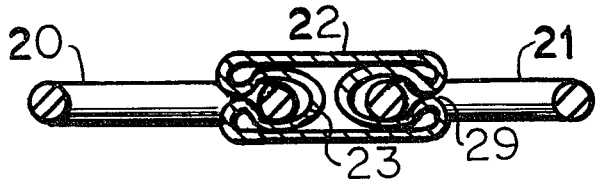
FIG. 2 is a transverse sectional view taken on the line 2—2 of FIG. 1.
Figure 3:
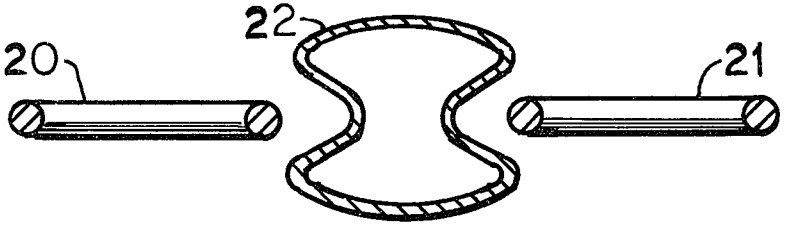
FIG. 3 is a transverse sectional view similar to FIG. 2 showing that embodiment in the released condition.

In FIG. 1 two connectors 20 and 21 are positioned in indents 23 in the wall of the closed end tubular case 22. The case 22 contains at the left end, lead wires 24 and 25 hermetically sealed with an insulator 26 closing the case 22. A bridgewire 27 joins the two lead wires and is coated with a pyrotechnic initiating and gas producing composition 28. The quantity and type of the pyrotechnic 28 may be varied to provide sufficient gas pressure to invert the indents and restore the case to cylindrical form without rupturing the case or base seal of the insulator 26. The electropyrotechnic link is easily assembled by positioning the connectors in the preformed indents 23 and crimping the indents closed around the connectors as at 29 as seen in FIG. 2. The open loops of the connectors may be used to attach the electropyrotechnic link to a fire protection system or other system. In a fire protection system the connectors may be placed under a spring tension tending to pull them apart, however as is seen in FIG. 3 the action of the expanding case 23 will first release the grip on the connectors and then expel the connectors from their initial position. The case 22 as shown in FIG. 3 is only partially expanded as it would be at a point in the operating cycle where the connectors are released. The case may subsequently expand further to assume a cylindrical form however full expansion to cylindrical form is not required for satisfactory operation.

Figure 4:
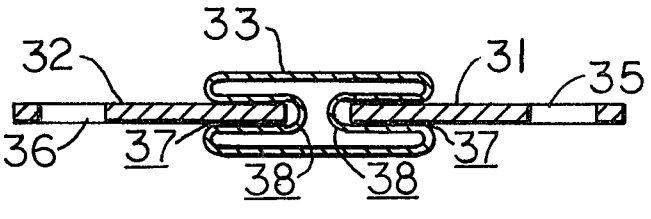
FIG. 4 is a transverse sectional view similar to FIG. 2 of a differemt embodiment of the present invention.

FIG. 4 shows a different embodiment of the present invention, in this embodiment shown in transverse section similar to FIG. 2, the connectors are bonded into preformed indents in the case and are not held by crimping the case over the connectors. The connectors 31 and 32 are shown having slits 35 and 36 for attachment to an external system. The connectors are bonded into preformed indents in the case 33 by a solder or adhesive 37. The indents 38 are formed to have a small clearance between the width of the indent and the thickness of the connector. The actual clearance chosen should match the bonding agent chosen, however clearance of 0.003 inch between the connector and the case results in bonds of good strength with both low temperature solders and adhesive bonding agents. The bond shown at 37 may be applied to only one side of each connector or to both sides to achieve maximum pull strength. When the link of this embodiment is activated by an external electrical signal the expanding case peels away from the stiffer connector and releases the connectors in the same manner as the embodiment shown in FIG. 3. If however the link is not electrically actuated the link will still release the connectors when the link is subjected to elevated temperatures which melt the bonding material at 37 as in the case of a fire.

Figure 6:
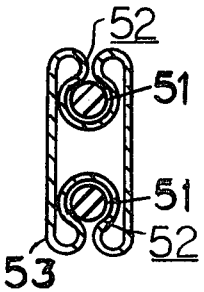
FIG. 6 is a transverse sectional view taken on the line 6—6 of FIG. 5.
Figure 5:
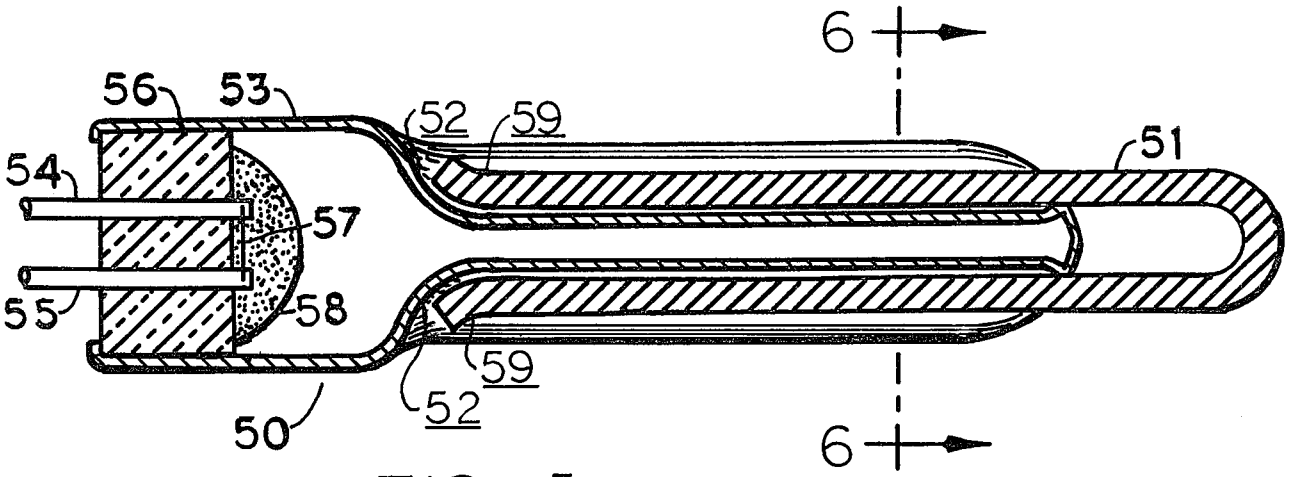
FIG. 5 is a plan view in section similar to FIG. 1 of yet another embodiment of the invention.

FIGS. 5 and 6 show yet another embodiment of the present invention having an axial rather than a transverse release function. This embodiment has particular application where a cluster of release mechanisms is required in a confined space such as in chaff dispensing countermeasures devices. In FIGS. 5 and 6 the connector 51 is shown crimped into both indents 52 of the case 53. The case 53 is similar to the case shown in FIG. 1 having two lead wires 54 and 55 hermetically sealed with an insulator 56, a bridgewire 57 joins the two lead wires and is coated with a suitable gas producing pyrotechnic charge 58. The connector 51 is formed in the shape of a hairpin and has the ends flared outward at 59 to increase the withdrawl force required to pull the connector out of crimped indents 52. Alternately hairpin like waves or one or more bulges may formed on the connector shank to provide resistance to withdrawl prior to actuation. While the links shown in these figures all have cases with two indents and connectors engaging the two indents the device of the invention can be made with one, three, four or more indents if desired and more than one connector can be fitted in a single indent or an indent may be left empty if a connector is not required in that position.

The gas producing pyrotechnic charges 28 and 58 shown in the figures produce a small amount of heat as well as gas pressure. By adjusting the composition of the pyrotechnic charge the amount of heat can be increased to a point sufficient to melt the bonding agent causing the release of the connector without expanding the case. For example a case 33 as in FIG. 4 could be charged with the military A1A ignition powder which produces considerable heat but very little gas pressure, in which case the connectors would be released by melting of the bonding agent only.

What is claimed is:

1. An electropyrotechnic link comprising:

a tubular case having an open end and a closed end and at least one indented wall portion extending longitudinally along the case;

at least one connector having a mounting portion releasably attached to the tubular case within the longitudinally indented wall portion of the case and free of engagement with the non-indented wall portions of the case and having another portion extending from the mounting portion for connection with another object;

an electrically activated pyrotechnic charge sealed within the open end of said tubular case so as to discharge within the case and cause the release of the connector when the charge is activated.

2. The electropyrotechnic link as defined in claim 1 wherein the connector is attached in the indented portion of the case wall by a crimp enveloping the mounting portion of the connector.

3. The electropyrotechnic link as defined in claim 2 wherein the pyrotechnic charge is a gas producer whereby the release of the connector results from expansion of the case by pyrotechnic gas pressure thereby opening said indented portion and removing the crimp of the case wall enveloping the mounting portion of the connector.

4. The electropyrotechnic link as defined in claim 1 wherein a bonding agent is interposed at the interface between the mounting portion of the connector and the indented wal portion to attach the connector and casing.

5. The electropyrotechnic link as defined in claim 4 wherein the pyrotechnic charge is a gas producer whereby the release of the connector results from expansion of the case by pyrotechnic gas pressure thereby opening said indented portion and peeling the interposed bonding agent from the case-to-connector interface.

6. The electropyrotechnic link as defined in claim 4 wherein the bonding agent is a fusible bonding adhesive whereby the release of the connector results from the heat of the pyrotechnic charge melting the bond adhesive.

7. The electropyrotechnic link as defined in claim 1 wherein a fusible solder is interposed at the interface between the mounting portion of the connector and the indented wall portion to attach the connector and casing.

8. The electropyrotechnic link as defined in claim 7 wherein the pyrotechnic charge is a gas producer when discharged whereby the release of the connector results from expansion of the case by pyrotechnic gas pressure thereby opening said indented portion and peeling the fusible solder bond from the connector-to-case interface.

9. The electropyrotechnic link as defined in claim 7 wherein the pyrotechnic charge is an ignition powder producing substantial heat whereby the release of the connector results from the heat of the pyrotechnic charge melting the fusible solder bond between the case and the connector.

10. The electropyrotechnic link of claim 1 wherein the longitudinally indented wall portion of the casing is folded about the mounting portion of the connector.

11. The electropyrotechnic link of claim 1 wherein:

the mounting portion of the connector is elongated and cylindrical and lies within the longitudinally indented portion of the tubular casing; and the longitudinally indented portion is folded around and envelopes the elongated and cylindrical mounting portion of the connector to attach the casing and the connector.

* * * * *